US007520743B1

(12) United States Patent
Roberts

(10) Patent No.: US 7,520,743 B1
(45) Date of Patent: Apr. 21, 2009

(54) METHOD AND APPARATUS TO REDUCE A VENTING OF RAW NATURAL GAS EMISSIONS

(75) Inventor: Leslie Clifford Roberts, Lyons, CO (US)

(73) Assignee: Chemical Applications and Engineering, Inc., Lyons, CO (US)

( * ) Notice: Subject to any disclaimer, the term of this patent is extended or adjusted under 35 U.S.C. 154(b) by 16 days.

(21) Appl. No.: 11/619,161

(22) Filed: Jan. 2, 2007

(51) Int. Cl.
*F23D 14/00* (2006.01)
*F23G 7/08* (2006.01)

(52) U.S. Cl. ..... 431/5; 431/202; 210/180; 196/46

(58) Field of Classification Search ..... 196/46; 210/180; 431/5, 6, 202, 231
See application file for complete search history.

(56) References Cited

U.S. PATENT DOCUMENTS 4,126,419 A 11/1978 Katabuchi et al.
4,177,742 A 12/1979 Uemera et al.
4,235,325 A * 11/1980 Miller ..... 196/46
4,308,806 A 1/1982 Uemera et al.
4,396,404 A 8/1983 Engelman et al.
4,424,068 A 1/1984 McMillian
4,437,186 A 3/1984 Inai
4,479,486 A 10/1984 Manning et al.
4,485,746 A 12/1984 Erlandsson
4,573,911 A 3/1986 Kimmich
4,702,692 A 10/1987 Burns et al.
4,779,677 A 10/1988 Cobb
5,010,830 A 4/1991 Asuka et al.
5,020,455 A 6/1991 Takashi et al.
5,046,435 A 9/1991 Kugler
5,070,850 A * 12/1991 Davis et al. ..... 123/527
5,081,937 A 1/1992 Ishida et al.
5,132,011 A * 7/1992 Ferris ..... 96/184
5,245,937 A 9/1993 Nakase et al.
5,527,449 A * 6/1996 Brown et al. ..... 208/179
5,707,510 A 1/1998 Berry
5,755,846 A 5/1998 Wagner et al.
6,065,387 A 5/2000 Blair
6,146,131 A 11/2000 Wiseman
6,179,212 B1 * 1/2001 Banko ..... 236/1 E
6,494,711 B1 12/2002 Takemura et al.
6,652,265 B2 * 11/2003 Cain ..... 431/6
6,748,881 B1 6/2004 Heran et al.
2004/0166043 A1 8/2004 Vandine et al.

* cited by examiner

*Primary Examiner*—Kenneth B Rinehart
*Assistant Examiner*—Chuka C Ndubizu
(74) *Attorney, Agent, or Firm*—Aileen Law; A Law Firm, P.C.

(57) ABSTRACT

With the disclosed device, some or all of the available oil tank vent gas in a production system can be utilized to augment the primary fuel gas needed by a heater treater unit to separate the gas, oil, and water fractions from raw natural gas extracted at the wellhead. Augmenting the primary fuel gas with vent gas reduces the demand for primary fuel gas, which thereby increases the amount of gas traversing a meter. The disclosed device also provides for an auxiliary burner unit that can directly address any available oil tank vent gas that is not utilized to augment fuel gas as waste gas. A method and apparatus for reducing the venting of raw natural gas emissions from an oil storage tank is described.

13 Claims, 4 Drawing Sheets

METHOD AND APPARATUS TO REDUCE A VENTING OF RAW NATURAL GAS EMISSIONS

FIELD OF ART

The disclosed device relates generally to a method and apparatus for reducing the venting of raw natural gas emissions from an oil storage tank, and more specifically to a method and apparatus for recycling the oil tank vent gas to a heater treater unit to augment a primary fuel gas source.

BACKGROUND

Oil and natural gas are often found together in the same reservoir. The composition of the raw natural gas extracted from producing wells depends on the type, depth, and location of the underground deposit and the geology of the area.

Natural gas processing begins at a wellhead. Most natural gas production contains to varying degrees, small (two to eight carbons) hydrocarbon molecules in addition to methane. Although the molecules exist in a gaseous state at underground pressures, these molecules will become liquid and condense at normal atmospheric pressure. Collectively, they are called condensates or natural gas liquids (NGLs). The pipe-line quality natural gas received and transported by mainline transmission systems must meet quality standards specified by various pipeline companies. In general, the natural gas cannot contain, among other things, more than trace amounts of compounds such as water vapor, nitrogen, carbon dioxide, etc. In addition, the natural gas should be transported at a specified dew point temperature below which vaporized gas liquid in the mixture will tend to condense at pipeline pressure.

The processing of wellhead natural gas into pipeline-quality dry natural gas can involve several processes to remove and/or separate constituents such as oil, water, and compounds comprising sulfur and carbon dioxide, and NGLs (condensate). In many instances, pressure relief at the wellhead will cause a natural separation of gas from oil. For example, gravity can cause the separation of the gas hydrocarbons from the heavier oil in a conventional closed tank. In some cases, however, a multi-stage gas-oil separation process can be implemented to separate the gas stream from the crude oil. This equipment typically comprises a separator, a heater treater, storage tanks, circulating pumps and a facility for the storage or disposal of water that is produced with the oil.

At a typical production facility, the separated water and condensate constituents can be diverted from the heater treater unit to storage tanks. Specifically, the water can be collected in a water storage tank until it is removed and/or transported to a disposal facility. The condensate fraction can be collected in an oil tank until it is removed and/or transported to a wholesale oil buyer and/or refinery. Natural gas, having undergone separation from the water and condensate constituents, can be separated and routed through a pipeline, commonly known as a sales line and a meter, to a gas gathering system where it can be sent to a compressor station and/or a gas processing facility to be compressed, refined, and sold to gas marketing companies.

A heater treater unit, or condensate separator, requires energy in the form of heat to accomplish the separation of the gas, oil, and water fractions. In addition, the heaters ensure that the temperature of the natural gas does not drop too low and cause a hydrate to form with the water vapor content of the gas stream. This heat is typically provided for by burning natural gas, diverted from the treater unit's gas section, as "fuel gas". Since natural gas was historically inexpensive, the oil and gas industry did not typically measure or economize the consumption of fuel gas in the treater unit. As the price of natural gas has increased, however, technologies for controlling unmeasured consumption can be more favored.

As stated above, gravity can cause the separation of the gas hydrocarbons from the heavier oil in a conventional closed tank. In addition, elevated temperatures effective for lowering oil viscosity and promoting phase separation can cause a significant percentage of these lighter hydrocarbons to volatilize while being stored in the condensate tank. These lighter hydrocarbons represent a gaseous volume in an oil tank. As gas pressure in the tank builds, these volatile hydrocarbons, including methane can vaporize and escape to the atmosphere. In some cases, it can become necessary to reduce the pressure by venting these gases through an outlet mounted at the top of the oil tank. Regulatory requirements for reducing raw gas emissions into the atmosphere have caused the industry to consider developing methods to reduce raw gas emissions from oil tanks. For example, gas combustors can be installed adjacent to production treater units to efficiently burn oil tank vent gas and avoid venting raw gas emissions to the atmosphere.

The disclosed device provides oil and gas producers an alternative to burning vent gas to avoid venting gas to atmosphere. The disclosed device also provides a method of economizing the consumption of fuel gas in the treater unit by recycling the oil tank vent gas to the heater treater to augment its primary fuel.

SUMMARY OF THE DISCLOSURE

Heater treaters are used to treat flow volumes from wellheads, which can be stable mixtures of oil, solids, and water. These units can utilize thermal, gravitational, mechanical, and chemical methods to break the mixtures and separate crude oil from water. Elevating temperature can be a particularly effective method in separating the oil, gas, water mixture and promoting phase separation for the treatment of the oil, gas, water mixture. However, higher heater treater temperatures can cause lighter hydrocarbons, including methane, to volatilize and escape to the atmosphere from production tanks, resulting in increased methane emissions.

Heat for a heater treater unit is typically provided for by burning diverted natural gas as fuel gas. The fuel gas is burned in a primary burner unit comprising a burner tip housed in a venturi shell. Air is pulled into the unit through an air vent. The flow rate of the primary fuel gas is controlled by a gas regulator which is set at about 15 psi which helps to maintain a constant burn. Because higher heater treater temperatures can result in increased methane emissions, the treater unit can be set to burn to a maximum temperature setting after which the fuel gas is characteristically shut off to the primary burner unit.

The effectiveness of phase separation affects the likelihood of having to recirculate produced oil to the heater treater for further treatment. Consequently, operators might generally be motivated to use more fuel gas to lessen the chances for high water content in the produced oil. Combined with manpower limitations that may not allow for constant monitoring at sites, field personnel may be inclined to operate the equipment at levels that cause the least production problems but that could also result in higher than necessary emissions. In addition, it is not uncommon for built-up gas to be vented to atmosphere through a relief valve mounted on the oil tank housing the gases. To avoid venting raw gas emissions directly to atmosphere, the raw gas is often burned.

Applicant has developed a method and apparatus that allows for all or part of the oil tank vent gas to be utilized to augment the primary fuel gas needed by the treater unit to separate the gas, oil, and water fractions from raw extracted natural gas. Augmenting the primary fuel gas with vent gas reduces the demand for primary fuel gas, which thereby increases the amount of gas entering the sales line and across the meter. This translates into an increase in gas sales. Further, Applicant's system addresses any oil tank vent gas that is routed for augmentation but which remains unused after the maximum temperature setting is met and the primary fuel gas is shut off. Unused oil tank vent gas can then be routed to an auxiliary burner unit in the vent stack to be burned as waste gas. In general, the disclosed device comprises a closed loop, two-stage system providing an augmented fuel gas stream to a primary burner unit and an auxiliary burner unit to attend to any vent gas that remains unused in fuel augmentation. This system comprises venturi to restrict a flow of vent gas and/or air in the primary and auxiliary burner units and thereby facilitates an injection of vent gas and/or air for the system's burner means.

The disclosed device incorporates a method of recycling the oil tank vent gas to a beneficial use rather than to simply burn the oil tank vent gas as a waste product of the production process. In the case that any portion of oil tank vent gas remains unused, it can be routed to an auxiliary burner unit to be burned as waste gas instead of being burned in adjacently installed gas combustors. The disclosed device provides field personnel with a method of identifying an using the lowest practical heater treater temperature capable of meeting product quality standards and other treatment factors and reducing vented emissions.

These and other advantages of the disclosed device will appear from the following description and/or appended claims, reference being made to the accompanying drawings that form a part of this specification wherein like reference characters designate corresponding parts in the several views.

Before explaining the disclosed embodiments of the disclosed device in detail, it is to be understood that the device is not limited in its application to the details of the particular arrangements shown, since the device is capable of other embodiments. Also, the terminology used herein is for the purpose of description and not of limitation.

DESCRIPTION OF THE DISCLOSED EMBODIMENT

The following description is provided to enable any person skilled in the art to make and use the disclosed apparatus. Various modifications, however, will remain readily apparent to those skilled in the art, since the generic principles of the present apparatus have been defined herein specifically to provide for an improved mixture treating apparatus and method.

Figure 1:
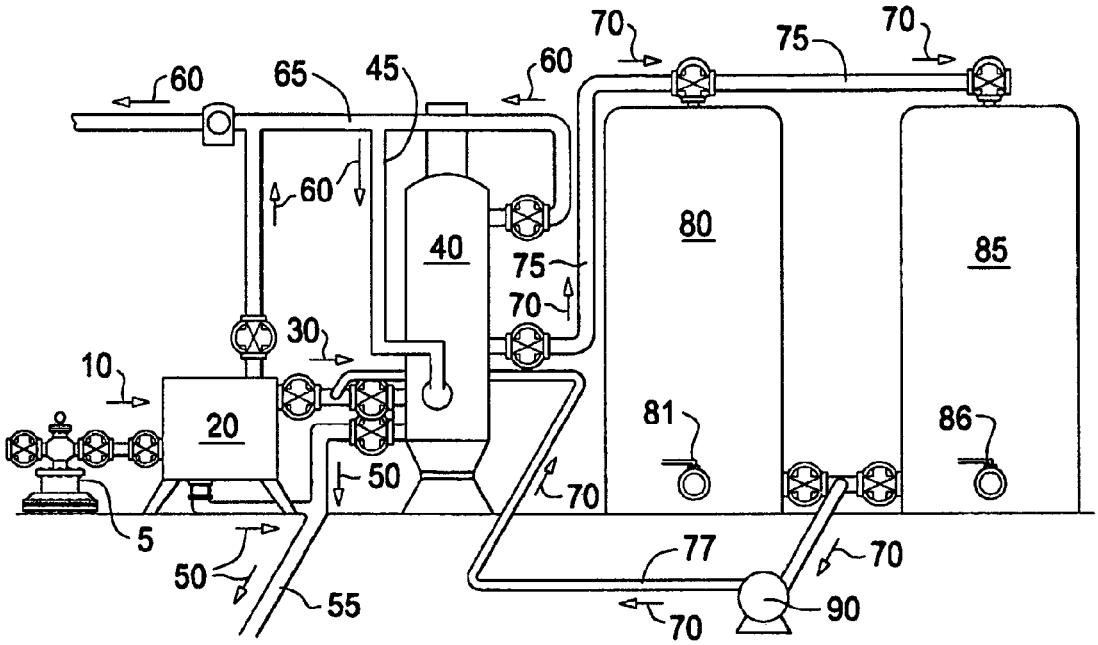
FIG. 1 is a schematic diagram illustrating production equipment typically connected to a producing well.

As shown in FIG. 1, production equipment can be installed on the ground surface near a completed well 5. During production, oil, gas, and water flow to the surface, passing as a mixture to a production separation system, which separates the gas from the oil and water. This mixture generally has a temperature of about 40° F. to about 100° F. and may be greater than about twenty-five percent (25%) to about fifty percent (50%) water. Oil, gas, and water, as a mixture 10, enter free water knockout 20 where some portions of gas and water are separated from the mixture. The freewater knockout tank can reduce the water content of a mixture to about a half percent (0.5%) water. Water 50 can be drained off and sent for disposal.

A gas-fired heater treater 40 can be utilized in oil and gas production facilities and gas gathering systems to make and transfer/apply heat to the natural gas that is produced from one of more production wells. These separators are commonly closed cylindrical shells, horizontally mounted with inlets at one end, an outlet at the top for removal of gas, and an outlet at the bottom for removal of oil. Although the process depicts a single flow path, it should be understood that additional flow paths for the crude oil production process could exist.

The partially treated mixture 30 enters heater treater 40 where it is heated between about 80° F. to about 150° F. wherein the mixture is separated into oil, gas, and water fractions. The treater can typically be operated at about 50 psig to about 170 psig. The exact operating conditions are a function of the crude oil properties, but higher temperatures are generally required to reduce the viscosity of heavy oil and higher pressures are generally required to stay above the saturation pressure of steam at the operating temperature to prevent foaming in the vessel.

Gas 60 passes into a gas line 65 where it is metered and sent to market. See also FIG. 2. Oil 70 is situated in heater treater 40 at a level lower than that for gas 60. Oil 70 flows through a conduit 75 to storage in one of several storage tanks, each generally having about a 300-barrel capacity, to await eventual transport. Here, oil 70 passes into tanks 80, 85. Built up gases may be vented to atmosphere through valve means (not shown) mounted on tanks 80, 85 which house the gases. For example, a 4" Enardo end-of-line vent valve can be set to relieve pressure to atmosphere at a range of about 12 to about 16 ounces per square inch. Thief hatches can work in tandem with a vent valve. Enardo's spring-loaded thief hatch Model 300 can be set at about 8 to about 12 ounces per square inch. These relief means can be designed to close once the tank pressure goes below the setting point.

Drain valves 81, 86 can discharge oil 70 for loading into trucks, for example, for transport. Before oil 70 is removed from tanks 80, 85, it can be tested to determine its impurity content. Pump 90 can be used for recirculating oil having impurities, such as water, back through treater 40 by means of conduit 77. Water 50 occupies the lower portion of heater treater 40. From heater treater 40, water 50 is transferred via conduit 55 to storage and/or disposal.

Figure 2:
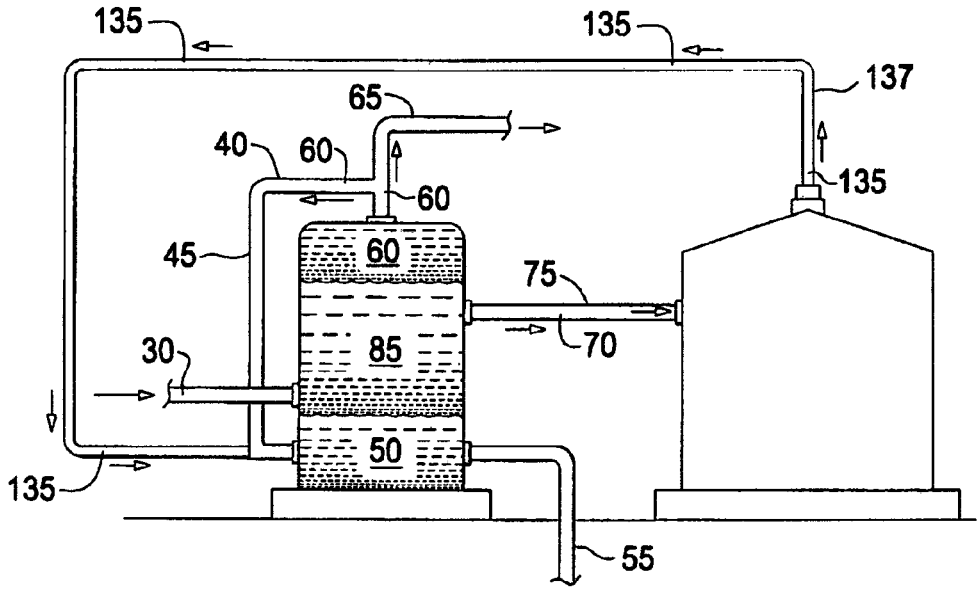
FIG. 2 is a schematic diagram showing a routing of oil tank vent gas to a heater treater.

Treater unit 40 requires energy in the form of heat to accomplish the separation of the gas, oil, and water fractions in mixture 30. This heat is typically provided by burning natural gas as fuel gas, which is diverted from treater unit's gas section. As stated above, natural gas 60 passes into gas line 65 where it is metered and sent to market. As can be seen in FIGS. 1, 2, some of natural gas 60 can be diverted for consumption as fuel in heater treater 40 via return line 45.

Figure 3:
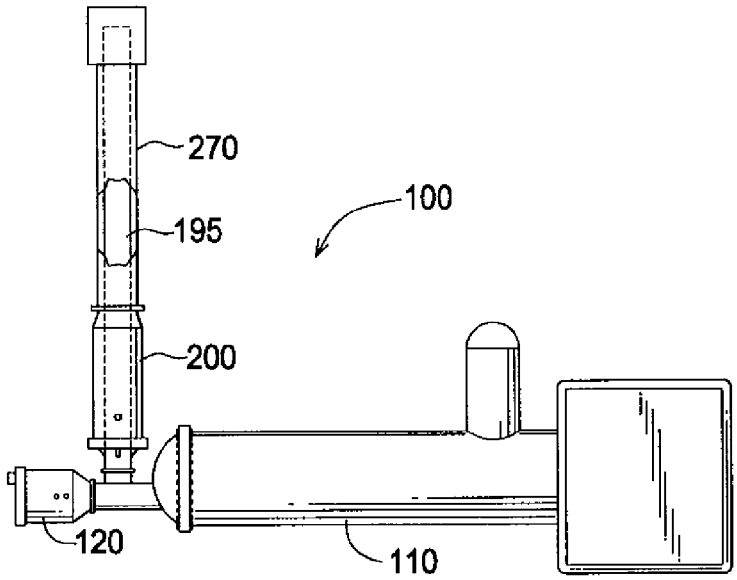
FIG. 3 is a side elevation view of one embodiment of the disclosed device.
Figure 3A:
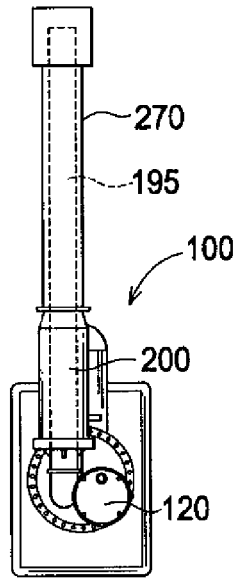
FIG. 3A is a front elevation view of the embodiment shown in FIG. 3.
Figure 3B:
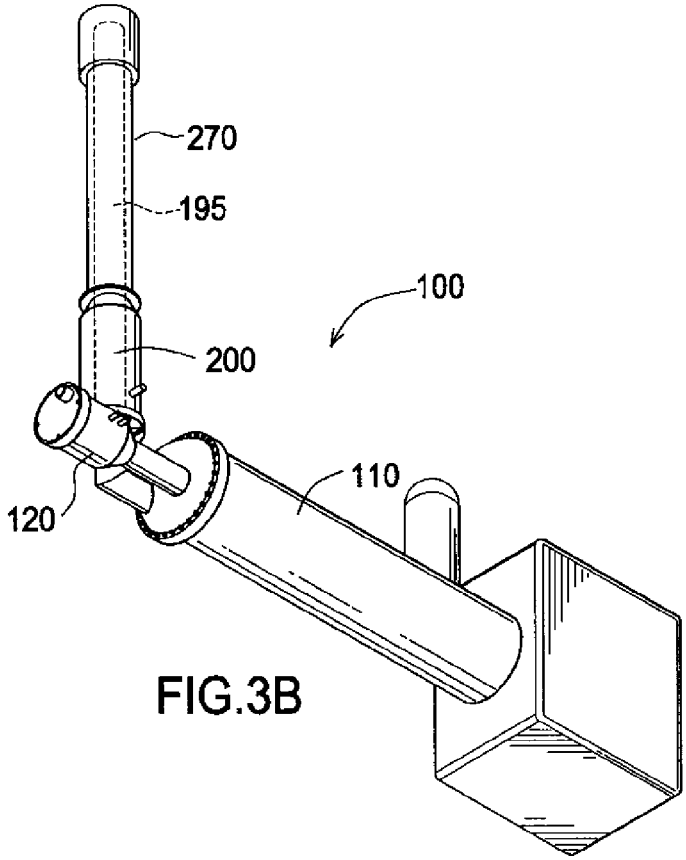
FIG. 3B is a bottom perspective view of the embodiment shown in FIGS, 3, 3A.

Diverted natural gas is burned as fuel gas in the heater treater's primary burner unit. Referring now to FIGS. 3, 3A, 3B, the oil field heater treater apparatus, is shown and generally designated by the numeral 100. Apparatus 100 comprises a vessel 110 which is schematically shown. As will be understood by those skilled in the art, there are a number of piping connections to vessel 110, which are not shown, through which the produced well fluid is directed to the vessel 110 and through which the various components, such as water, gas and liquid hydrocarbons, are subsequently drawn from vessel 110 after they are separated. Primary burner unit 120 extends horizontally into vessel 110. Secondary (or auxiliary) burner unit 200 is shown to extend vertically and adjacent from primary burner unit 120.

Figure 4:
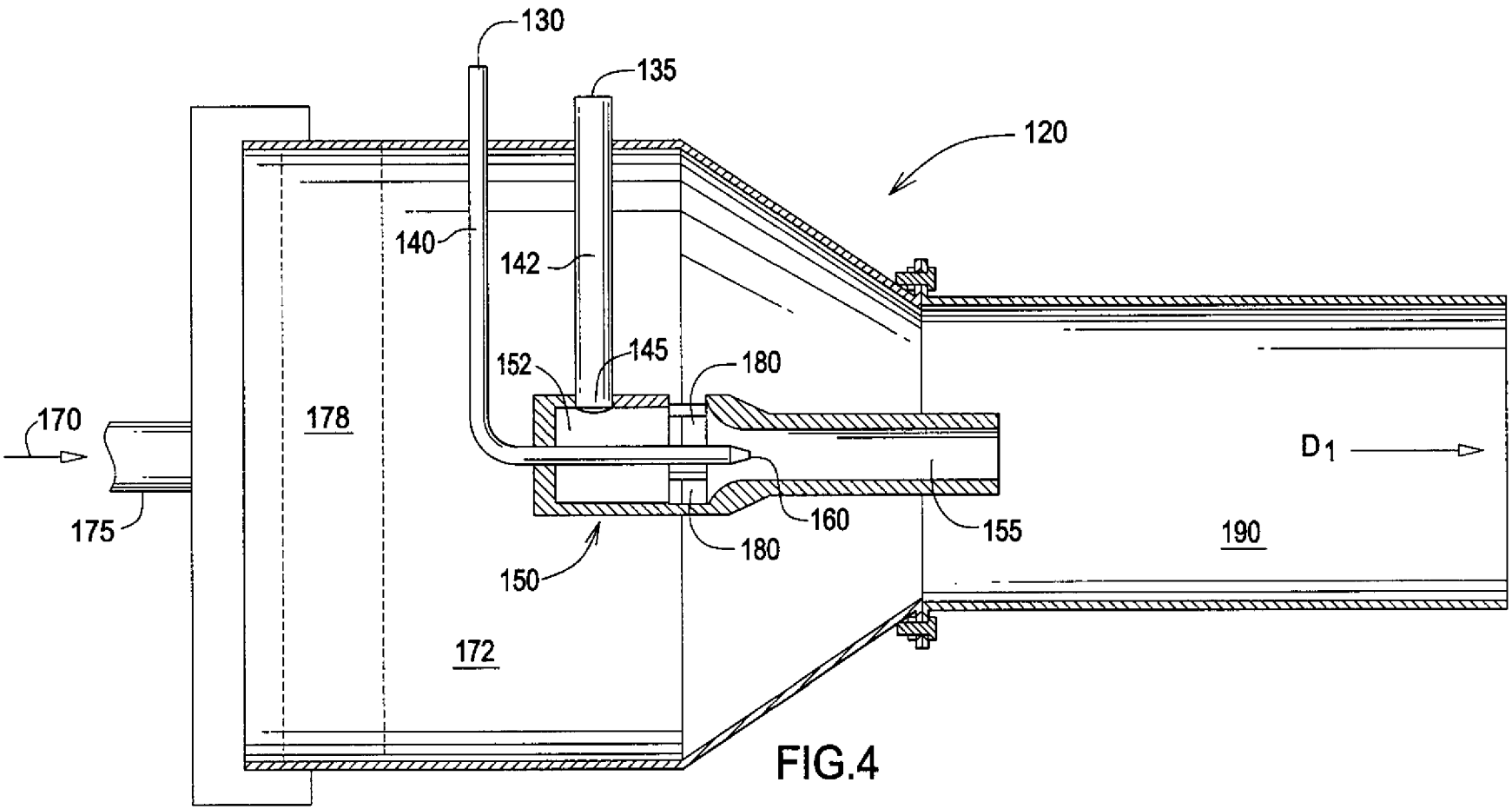
FIG. 4 is a partial cutaway front elevation view of a primary burner embodiment of the disclosed device.

As shown in FIG. 4, gas 60 as high pressure fuel gas 130 passes through a gas supply line 140 and enters an outlet end 155 of a venturi chamber 150 via a nozzle 160. Air 170 is pulled into the unit through intake ports 180. Fluid flow occurs according to Bernoulli's principle. In the case of fluid flow through a constricted tube or pipe, the fluid must speed up in the restriction, reducing its pressure and producing a partial vacuum. As the flow of air 170 is constricted before it enters outlet end 155 of venturi chamber 150, its velocity increases. Thus, air can be injected into primary burner unit 120 because of changes in pressure. Consequently nozzle 160 is housed in a venturi shell which extends into a combustion chamber 190 of the primary burner unit 120. At the end of the system, a mixture of air 170 and fuel gas 130 can appear. Although the exact operating conditions are a function of the crude oil properties, the mixture can typically be burned using a ring of pilot burner tips at about 15 psi (low pressure) to maintain a constant burn in combustion chamber 190. Field personnel may be able to estimate an appropriate air/gas ratio by ensuring that blue flame is visible. Other suitable configurations of burner tips, assemblies, etc. could be utilized.

The exhaust gas which is subsequently generated to elevate the temperature of a mixture enters vessel 110 (see FIGS. 3, 3A, 3B) in direction $D_1$ for phase separation purposes. To optimize phase separation, a controller (not shown) can be configured to measure a preset temperature or a range of temperatures. When the preset conditions are met, primary fuel gas to the primary burner unit can be suspended. After the exhaust gas exits from the combustion chamber, the disclosed device could contemplate a convection section where more heat can be recovered before flue gases are vented to atmosphere through primary burner flue 195. A flame arrester 178 can be mounted on air intake chamber 172 which is located behind the pilot burners (not shown) to inhibit flame propagation for fire protection and safety. Typically, the flame arrester, which can be constructed from a dense metallic mesh about six to about eight inches thick, is disposed across the inlet 175 of air intake chamber 172 to prevent flames from the burner from passing there through in the event of a backfire or the like of the pilot burners (not shown).

With the disclosed device, field personnel can opt to augment the fuel gas stream with available oil tank vent gas from one of several storage tanks. As can be seen in FIG. 2, oil tank vent gas 135 can be diverted to the primary burner unit 120 of heater treater 40 for consumption as fuel via return line 137.

High pressure fuel gas 130 passes through gas supply line 140 and enters outlet end 155 of venturi chamber 150 via gas nozzle 160. Air 170 is pulled into the unit through intake ports 180. Oil tank vent gas 135 passes through a vent gas supply line 142 and enters an inlet end 152 of venturi chamber 150 via an intake 145. Vent gas supply line 142 can be mounted in tandem fuel gas supply line 140. A second venturi occurs. As the flow of oil tank vent gas 135 is constricted before it enters outlet end 155 of venturi chamber 150, its velocity increases. The pressure differential experienced by the oil tank vent gas results in an injection of low pressure oil tank vent gas into the primary burner unit.

Augmentation of fuel gas can be referred to as a first stage in the two stage system provided for by the disclosed device. The second stage of the disclosed system addresses the remainder of available vent gas that has been routed for augmentation but which remains unused. As stated above, a controller (not shown) can be configured to measure a preset temperature or a range of temperatures that when met, result in the suspension of primary fuel gas to the primary burner unit. A controller (not shown) can be configured to similarly suspend the oil tank vent gas that was set aside to augment the fuel gas burned in the primary burner unit when a preset condition is met.

As can be seen in FIGS. 3, 3A, 3B, one embodiment of the auxiliary burner unit 200 can extend vertically and adjacent from primary burner unit 120. In this embodiment, a double flue is realized since the primary burner unit 120 and the auxiliary burner unit 200 share a vent stack. Although the auxiliary burner unit may be attached to or made a part of the vent stack for the primary burner component on the treater unit as illustrated by this example, other suitable configurations are possible and would still fall within the scope of the disclosure.

Figure 5:
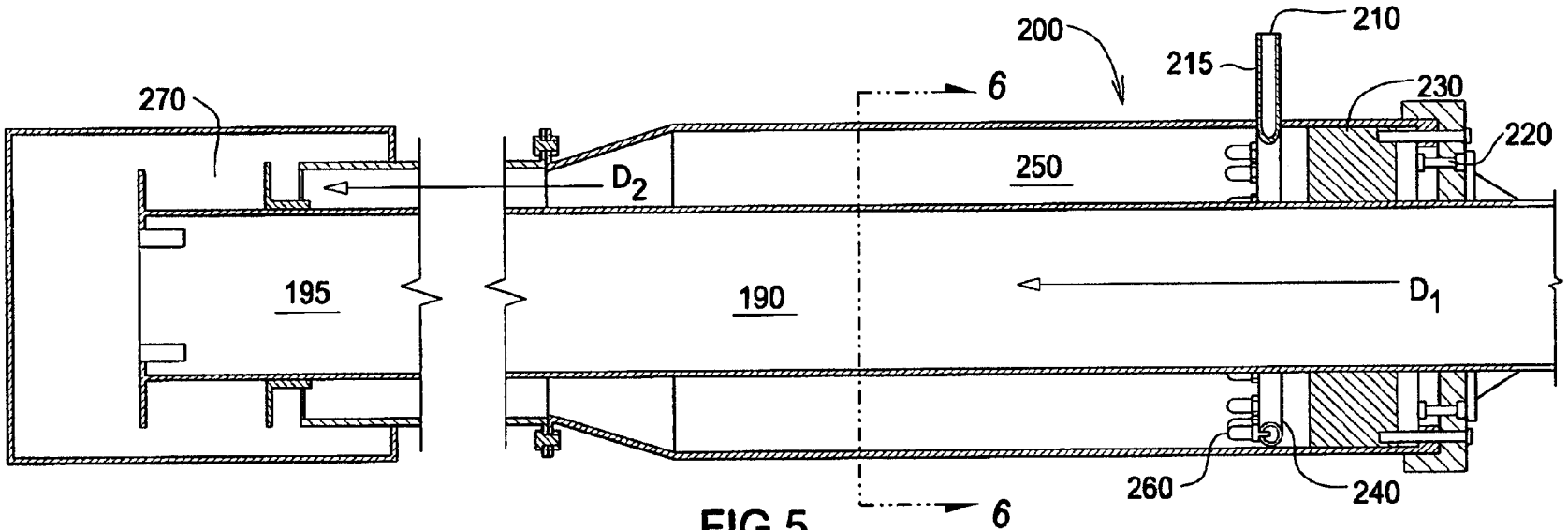
FIG. 5 is a partial cutaway front elevation view of an auxiliary burner embodiment of the disclosed device.

Referring now to FIG. 5, unused oil tank vent gas 210 can be routed to auxiliary burner unit 200 via supply line 215 to be burned as waste gas instead of being burned in adjacently installed gas combustors, thereby reducing the amount of equipment to be installed on a ground surface near a completed well and the related costs. A combustion air intake passage 220 is located behind a burner ring assembly 240. To prevent backfiring from occurring in a combustion vapor chamber 250, air intake passage 220 can be covered with a baffle screen 230. Burner nozzles 260 form a venturi with the greatest restriction being at that point where the openings are located, so that when unused oil tank vent gas 210 is routed through supply line 215, there will be a pulling force on air entering air intake passage 220 and on oil tank vent gas 210 because of their respective increased velocities at the restricted portion of the burner nozzles 260 in combustion vapor chamber 250.

Although the exact operating conditions are a function of the crude oil properties, the mixture can typically be burned using a ring burner assembly (see also FIG. 6) at about 15 psi (low pressure) to maintain a constant burn in combustion chamber 250. As stated above, field personnel may be able to estimate an appropriate air/gas ratio by ensuring that a blue flame is visible. Other suitable configurations of burner tips, assemblies, etc. could be utilized. Secondary burner exhaust gas can pass through auxiliary burner flue 270 in direction $D_2$ for venting to atmosphere.

Figure 6:
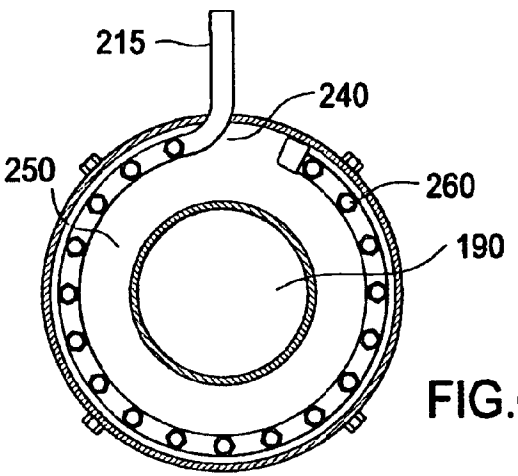
FIG. 6 is a sectional view along line 6-6 showing the burner assembly of the auxiliary burner embodiment of FIG. 5.

In the sectional view of FIG. 6, combustion chamber 190 of primary burner unit 120 can be seen housed within combustion vapor chamber 250 of auxiliary burner unit 200. Unused oil tank vent gas can be routed through supply line 215 to burner nozzles 260 of burner ring assembly 240.

TABLE 1 sets forth preliminary results of a performance-based evaluation of the effectiveness of the auxiliary burner unit. The purpose of the pilot test was to establish the range of flow pressures and flow rates (volumes) at which the auxiliary burner could operate, e.g., minimum, and maximum, and to determine the temperature of the burner stack for each set of flow pressures and volumes. It is known in the industry that the flash point temperature of methane gas is about 970° F. Therefore, to establish safety parameters, the auxiliary burner was monitored to ensure that its maximum burn potential did not exceed a stack temperature of about 970° F.

Four test runs were conducted. Each test run (or burn segment) occurred over a 15-minute period of time. In each case, the pressure of the primary burner was maintained at a constant rate of 15 psi. Available oil tank vent gas was routed to the heater treater to augment the amount of fuel gas required to break an oil/water mixture and separate water from the well fluid. The heater treater was heated from about 80° F. to about 150° F. and adjusted from about 50 psig to about 170 psig. When the primary fuel and recycled vent gas were shut off to the primary burner unit, the remaining vent gas was rerouted to the auxiliary burner unit. In each subsequent test run, pressure, flow rate, and temperature were increased. As can be seen in the fourth set of data, the auxiliary burner operated so as not to exceed the maximum of 970° F.

TABLE 1

| BURN SEGMENT | PRESSURE (oz./sq. in.) | FLOW RATE (cfm) | TEMPERATURE (F.) |
|---|---|---|---|
| 1 | 4.5 | 2.5 | 725 |
| 2 | 6.0 | 2.75 | 825 |
| 3 | 8.0 | 3.25 | 910 |
| 4 | 9.0 | 3.5 | 963 |

Although the disclosed device and method have been described with reference to disclosed embodiments, numerous modifications and variations can be made and still the result will come within the scope of the disclosure. No limitation with respect to the specific embodiments disclosed herein is intended or should be inferred.

I claim:

1. A heater apparatus comprising:

a vessel;

a first burner mounted thereto for burning a high pressure fuel gas in said vessel;

air intake passage means for directing air to said first burner;

routing means for directing at least a portion of a low pressure vent gas from an oil storage tank to said first burner;

wherein said portion of low pressure vent gas augments said high pressure fuel gas to form an augmented fuel gas to feed said burner for a period of time until a predetermined temperature is met, thereby causing a suspension of said augmented fuel gas to said first burner; and wherein a remaining portion of said vent gas from said oil storage tank is routable to a second burner dedicated for the combustion of low pressure vent gas as waste gas.

2. The apparatus of claim 1, wherein said augmentation comprises introducing said portion of said low pressure vent gas into a venturi apparatus housed in said first burner.

3. The apparatus of claim 1, wherein said second burner comprises a concentric set of burners mounted in a discrete stack flue chamber adapted to exhaust said low pressure vent gas as combusted.

4. In a crude oil heater treater comprising a crude oil inlet, a treated oil outlet, and an internal heating apparatus having a combustion-type gas burner and a waste gas outlet, a two-staged improvement comprising:

a diverted stream of a low pressure vent gas from an oil storage tank containing treated oil from said treated oil outlet;

wherein a first portion of said diverted stream is routed to said combustion-type gas burner to be combusted as fuel, thereby providing for a first stage of said improvement; and wherein a second portion of said diverted stream is routed to an auxiliary combustion-type gas burner to be combusted as waste gas, thereby providing for a second stage of said improvement.

5. A closed loop system comprising:

a treater unit having a first burner mounted thereto for burning a high pressure fuel gas;

routing means for directing at least a portion of a low pressure vent gas from an oil storage tank to a venturi apparatus housed in said first burner of said treater unit;

a constricted tube causing combustion air to be injected into said first burner, thereby allowing said treater unit to burn an augmented fuel gas comprising low pressure vent gas and high pressure fuel gas for a period of time until a predetermined condition is met, thereby causing a suspension of said augmented fuel gas to said first burner; and routing means for directing a remaining portion of said low pressure vent gas from said oil storage tank to a second burner of said treater unit to be burned as waste gas.

6. A method of reducing vent gas emissions to atmosphere, said method comprising the steps of:

providing a treater unit having a first burner mounted thereto for burning a fuel gas to separate gas, oil, and water fractions from a raw extracted natural gas stream;

directing at least a portion of a vent gas from an oil storage tank to a venturi apparatus housed in said first burner of said treater unit;

injecting combustion air into said first burner, thereby allowing a combustion of augmented fuel gas in said treater unit to occur for a period of time until a predetermined condition is met;

suspending said augmented fuel gas to said first burner; and directing a remaining portion of said vent gas from said oil storage tank to an auxiliary burner of said treater unit to be burned as waste gas.

7. The method of claim 6 further comprising the step of identifying a heater treater temperature capable of meeting product quality standards and other treatment factors and reducing vented emissions.

8. An apparatus comprising:

a vessel;

a burner mounted therein, said burner capable of combusting a low pressure vent gas in a combustion chamber housed in a stack of said vessel;

air intake passage means for directing air to said burner;

routing means for directing a portion of said low pressure vent gas from said oil storage tank to said burner to be combusted as waste gas;

routing means for directing a portion of said low pressure vent gas from said oil storage tank to a burner capable of burning a high pressure fuel gas in said vessel, wherein a burning of said portion of low pressure vent gas causes a separation of gas, oil, and water fractions from a raw extracted natural gas stream to occur; and wherein said low pressure vent gas is exhausted from a first stack flue and said high pressure fuel gas is exhausted from a second stack flue, each of said stack flues discretely housed in said vessel's stack.

9. The apparatus of claim 8, wherein said burner further comprises a ring of nozzles.

10. A method of reducing vent gas emissions to atmosphere, said method comprising the steps of:

providing a unit having a burner, said burner mounted in a chamber for combusting a low pressure vent gas from an oil storage tank;

directing at least said portion of an oil storage tank vent gas to said combustion chamber;

constricting a flow of said vent gas at said burner to cause a pulling of air from an intake passage means and said vent gas to occur;

combusting said vent gas as a waste gas to avoid venting gas emissions to atmosphere;

directing a portion of said oil storage tank vent gas to a burner capable of burning a high pressure fuel gas in said vessel, wherein a burning of said portion of vent gas causes a separation of gas, oil, and water fractions from a raw extracted natural gas stream to occur; and exhausting low pressure vent gas from a first stack flue and high pressure fuel gas from a second stack flue, each of said stack flues discretely housed in said vessel's stack.

11. The apparatus of claim 4, wherein said combustion-type gas burner means further comprises a venturi apparatus to increase the velocity of said first portion before its combustion as an augmentation fuel.

12. The apparatus of claim 4, wherein said auxiliary combustion-type gas burner means is housed in a double-walled exhaust stack having an inner flue section to exhaust combusted primary fuel and an outer flue section to exhaust said second portion as combusted vent gas or waste gas.

13. The apparatus of claim 12, wherein said outer flue comprises a separate ignition source and a concentric set of burners to enable a combustion of said second portion.

* * * * *